US005114653A

United States Patent [19]

Schuerhoff et al.

[11] Patent Number: 5,114,653

[45] Date of Patent: May 19, 1992

[54] PROCESSES OF MANUFACTURING PRESTRESSED CONCRETE

[75] Inventors: Hans-Juergen Schuerhoff, Wuppertal, Fed. Rep. of Germany; Arie Gerritse, Rotterdam; Lambertus C. Mets, Arnhem, both of Netherlands

[73] Assignees: Akzo N.V.; Hollandsche Beton Groep N.V., both of Netherlands

[21] Appl. No.: 366,291

[22] Filed: Jun. 13, 1989

Related U.S. Application Data

[63] Continuation of Ser. No. 927,961, Nov. 7, 1986, abandoned.

[30] Foreign Application Priority Data

Nov. 7, 1985 [NL] Netherlands ..... 8503052

[51] Int. Cl.[5] ..... B32B 27/34

[52] U.S. Cl. ..... 264/228; 264/333; 428/395

[58] Field of Search ..... 264/228, 229, 333; 428/361, 395, 373, 327

[56] References Cited

U.S. PATENT DOCUMENTS

| | | | |
|---|---|---|---|
| Re. 27,061 | 2/1971 | Rubenstein | 264/228 X |
| 1,128,480 | 2/1915 | Miller | 264/293 |
| 2,571,717 | 10/1951 | Howald et al. . | |
| 2,694,661 | 11/1954 | Meyer . | |
| 2,749,266 | 6/1956 | Eldred | 264/137 |
| 2,921,463 | 1/1960 | Goldfein | 264/228 X |
| 3,111,569 | 11/1963 | Rubenstein | 52/396 |
| 3,214,877 | 11/1965 | Akin | 264/228 X |
| 3,244,784 | 4/1966 | Boggs | 264/137 |
| 3,637,457 | 1/1972 | Gothard et al. | 264/228 X |
| 3,819,794 | 6/1974 | Kidron | 264/228 |
| 3,878,278 | 4/1975 | Miller et al. | 264/228 X |
| 3,960,473 | 6/1976 | Harris | 425/467 |
| 4,040,775 | 8/1977 | Nordback | 264/228 X |
| 4,173,486 | 11/1979 | Cheetham et al. | 428/375 X |
| 4,174,366 | 11/1979 | Schneider | 264/228 |
| 4,194,873 | 3/1980 | Killmeyer | 425/93 |
| 4,224,377 | 9/1980 | Moens | 428/361 X |
| 4,244,765 | 1/1981 | Tokuno | 264/137 |
| 4,297,414 | 10/1981 | Matsumoto | 52/659 |
| 4,306,911 | 12/1981 | Gordon et al. | 106/99 |
| 4,337,155 | 6/1982 | Sasaki et al. | 428/361 X |
| 4,483,727 | 11/1984 | Eickman | 156/181 |
| 4,514,245 | 4/1985 | Chabrier | 156/161 |
| 4,515,636 | 5/1985 | Carney et al. | 428/375 X |
| 4,532,275 | 7/1985 | Aito et al. | 428/395 X |
| 4,535,027 | 8/1985 | Kobashi et al. | 428/367 |
| 4,608,089 | 8/1986 | Gale et al. | 106/99 X |
| 4,632,864 | 12/1986 | Cordova et al. | 428/395 X |
| 4,648,224 | 3/1987 | Kitta et al. | 52/727 |
| 4,661,387 | 4/1987 | Watanabe et al. | 428/375 X |
| 4,678,821 | 7/1987 | Logullo, Sr. et al. | 428/375 |
| 4,758,393 | 7/1988 | Cazenave et al. | 264/228 |
| 4,770,832 | 9/1988 | Okamoto et al. | 264/292 |
| 4,786,341 | 11/1988 | Kobatake et al. | 156/172 X |

FOREIGN PATENT DOCUMENTS

| | | |
|---|---|---|
| 705294 | 3/1965 | Canada . |
| 0062491 | 10/1982 | European Pat. Off. . |
| 63515 | 10/1982 | European Pat. Off. . |

(List continued on next page.)

OTHER PUBLICATIONS

"*Zelfs beton vraagt aandacht*", (Even concrete requires attention) by Ir. W. R. de Sitter, Hollandsche Beton- (List continued on next page.)

*Primary Examiner*—Jan H. Silbaugh
*Assistant Examiner*—Karen Aftergut
*Attorney, Agent, or Firm*—Stevens, Davis, Miller & Mosher

[57] ABSTRACT

Methods of forming cast prestressed concrete elements and structures include a non-corrosive reinforcing element being formed of a plurality of substantially parallel continuous filaments embedded in a matrix of thermosetting resin. These reinforcing elements are tensioned, then concrete cast about the elements is permitted to harden and the tension transferred to the now-hardened concrete in order to prestress the same. The resulting concrete elements and structures have high resistance to alkali induced corrosion of the prestressing elements.

15 Claims, 11 Drawing Sheets

FOREIGN PATENT DOCUMENTS

| | | |
|---|---|---|
| 0064167 | 11/1982 | European Pat. Off. . |
| 0127198 | 12/1984 | European Pat. Off. . |
| 170499 | 2/1986 | European Pat. Off. . |
| 0144983 | 6/1986 | European Pat. Off. . |
| 1925762 | 1/1970 | Fed. Rep. of Germany . |
| 2653422 | 6/1977 | Fed. Rep. of Germany . |
| 2756917 | 7/1978 | Fed. Rep. of Germany . |
| 2848731 | 7/1981 | Fed. Rep. of Germany . |
| 45-23431 | 8/1970 | Japan . |
| 51-6071 | 1/1976 | Japan . |
| 54-148087 | 11/1979 | Japan . |
| 55-55828 | 4/1980 | Japan . |
| 55-61430 | 5/1980 | Japan . |
| 57-156363 | 9/1982 | Japan . |
| 58-170963 | 10/1983 | Japan . |
| 59-199809A | 11/1984 | Japan . |
| 60-187534 | 9/1985 | Japan . |
| 7108534 | 2/1973 | Netherlands . |
| 937207 | 6/1982 | U.S.S.R. . |
| 1425032 | 2/1976 | United Kingdom . |
| 1543586 | 4/1979 | United Kingdom . |
| 2042411A | 9/1980 | United Kingdom . |
| 2051667A | 1/1981 | United Kingdom . |

OTHER PUBLICATIONS grorp N.V.; Dept. S&O (See the Journal Cement, Mar. 1983).

*CUR VB*-84-6, "*Agressiviteit Milieu en Duurzaamheid Betonconstructies*", (Agressiveness of Environment and Durability of Concrete Structures).

*CUR VB*-84-1, "*Corrosie van de wapening in gewapende betonconstracties*", *(Corrosion of the reinforcement in reinforced concrete structures).*

"*Kunstharz gebundene Glasfaserstabe—eine Korrosionsbestandige Alternative zum Spannstahl*", by Martin Weiser and Lothar Preis on pp. 79-85 of the book Fortschritte im konstruktiven Ingenierball, published by Rolf Eligehausenund Dieter Rustwaren, Verlag Ernst und Sohn, 1984, Berlin.

"A preliminary investigation of the use of fibre-glass for prestressed concrete" by Ivan A. Rubinsky and Andrew Rubinsky, Magazine of Concrete Research, Sep. 1954, pp. 71-78.

"Lifetime Predictions for Polymers and Composites Under Constant Load", by R. M. Christensen, Lawrence Livermore Laboratory, University of California, in Journal of Rheology, 25(5), pp. 517-528 (1981).

"*High Performance Matrix Resin System*", by T. J. Galvin, M. A. Chaudhari and J. J. King of Ciba-Geigy Corp. on pp. 45-48 of Chemical Engineering Process, Jan. 1985.

"*Kunststof profielen met glasvezelwapening*", (Glassfibre reinforced section of synthetic material) in the journal Metaal en Kunststof of 1983-02-04.

"Properties of cement composites reinforced with Kevlar fibres", Journal of Materials Science, vol. 13 (1978), pp. 1075-1083.

PROCESSES OF MANUFACTURING PRESTRESSED CONCRETE

This application is a continuation of Ser. No. 927,961, filed Nov. 7, 1986, now abandoned.

FIELD OF THE INVENTION

The invention relates to a reinforcing element for use in concrete more particularly for use in prestressed concrete, formed of a matrix containing a thermosetting synthetic material in which more than 5,000, more particularly more than 15,000 parallel continuous filaments are included therein. The invention also comprises prestressed or unprestressed reinforced concrete, in which reinforcement is provided by the reinforcing element. The invention further comprises a process for manufacturing the reinforcing elements, and processes of manufacturing reinforced concrete or prestressed concrete provided with the reinforcing elements.

As is known, steel is the primary reinforcement material of concrete and prestressed concrete. The use of steel is the material of choice because it possesses favorable mechanical properties, such as high strength and a high modulus of elasticity. Additionally, in the alkaline environment of concrete and cement mortar the steel embedded therein is not corroded; in other words the durability of reinforced concrete exposed to air depends on the continuous presence of the alkaline environment so that steel reinforcement is protected from corrosion. However, under the influence of $CO_2$ in the atmosphere the free lime in the concrete is bound, and as a result alkalinity will decrease. Such a process is called carbonation. A decrease in the alkalinity of the concrete, particularly below a pH of 10, may give rise to the corrosion of the steel. From the outer surface inwards the carbonation depth increases with time and as soon as the carbonation depth has become equal to the thickness of the concrete cover, the steel reinforcement may begin to rust, which in principle may lead to considerable damage of the concrete construction and may shorten its useful life. Atmospheric pollution, which has been on the rise, contains carbon dioxide and reactive sulphur, chlorine and nitrogen compounds, which may in principle lead to the deterioration of the steel. Air pollution is not only found in the immediate vicinity of the industry, but also at great distances from it and therefore the formation of acid rain having a pH 5, also may result in the deterioration of steel. These environmental problems are expected to become even greater in the future. For a disclosure of more of the problems relating to the use of steel as a reinforcing material reference may be made to the article "Zelfs beton vraagt aahdacht" ("Even concrete requires attention"), by Ir. W. R. de Ritter, Hollandse Betongroep N. V. Dept. S & O (see the Journal: *Cement*, March 1983), and CUR VB-84-6 "Agressivieeit Mulieu en Duurzaamheid Betonconstructies" ("Agressiveness of Environment and Durability of Concrete Structures") and CUR VB-84-1 "Corrosie van de wapening in gewapende betonconstructies" ("Corrosion of the reinforcement in reinforced concrete structures") published by the "Stichting voor onderzoek, voorschriften en kwaliteitseisen op het gebied van beton" ("Institute for tests, regulations and quality standards in the field of concrete").

Consequently, reinforced concrete structures containing steel reinforcement that have been exposed to atmospheric pollution or other chemically reactive environments have been found in recent years to be damaged by corrosion. Durability therefore does not meet expectations and high costs of repair must be reckoned with.

To solve the above-described corrosion problems attempts have been made to find alternative reinforcing materials that display similar physical and mechanical properties to that of steel but which are not as sensitive to the steel-corroding environment. Up to the present invention the only eligible materials of any practical value were glass or glass fibers. Although glass does have the desired mechanical and physical properties and even though it withstands corrosion, it generally displays insufficient chemical resistance to the alkaline environment ($pH > 12$) prevailing in non-carbonated concrete. Synthetic yarns that are melt spun from polymers such as polyethylene terephthalate, polyolefins and polyamide that do display the necessary chemical resistance have physical and mechanical properties, such as a very low modulus of elasticity, a high creep, etc., that renders them totally unsuitable as an alternative, for reinforcing and prestressing material for concrete.

Research has also led to the development of non-steel reinforcing elements that have been tested on a small scale, which in actual practice are formed of a matrix based on a thermosetting synthetic material in which there are more than 5,000 practically parallel continuous glass filaments. Such reinforcing elements and their use in concrete and various manufacturing methods are described in the article "Kunstharz gebundene Glasfaserstabe—eine Korrosiensbestandige Alternative zum Spannstahl" by Martin Wieser and Lothar Preis on pp. 79–85 of the book "Fortschritte im konstruktiven Ingenierbau", published by Rold Eligehausen and Dieter Russwurm, Verlag Ernst und Sohn, 1984, Berlin. In that article consideration is given to the replacement of prestress steel, in concrete, with reinforcing elements which consist of a large number of glass filaments in a matrix of synthetic material of unsaturated polyester resin. These known reinforcing elements have been successfully used outside the concrete field, especially in view of their suitable physical and mechanical properties and in view of their resistance to chemical attack particularly their resistance to acids. From the considerations on page 81 (right hand column) and page 82 in the article of Weiser and Preis, it appears, however, that there are problems in the resistance of these known reinforcing elements to the alkaline environment prevailing in concrete or cement mortar. Under points 4.1, 4.2 and 4.3 of the article three different solutions to these problems are discussed. One alternative relates to protection in the form of modifying the synthetic matrix (of an unspecified composition) so that during loading the formation of cracks down to as far as the glass filaments is avoided. Another alternative consists in providing the reinforcing element with a special sheath. A third possibility relates to the use of a special injection mortar. However, this third alternative is not only laborious but is only applicable in the costly process of making prestressed concrete. That is during the pouring of the concrete, channels must be maintained so they may be positioned within the hardened mix, and after the pour is hardened reinforcing elements in the channel are stressed by corrosion sensitive anchoring elements and then the special mortar is injected. This last-mentioned solution is so complicated and costly that instead of employing the well-known reinforcing elements of glass filaments and unsaturated polyester resin, use is better made of the less costly conventional reinforcement material for prestressing steel.

An object of the invention is to provide a novel reinforcing element of the type mentioned in the opening paragraph which, however, does not display the problems encountered with known reinforcing elements. The reinforcing element according to the invention has physical and mechanical properties which are similar to that of steel. Further, the reinforcing element according to the invention is chemically resistant to the environment in which steel corrodes. Moreover, within the life expectancy of concrete structures, the reinforcing element according to the invention is insensitive to the alkaline environment in non-carbonated concrete, so that it can be used in direct contact with cement or concrete mortar. The reinforcing element according to the invention is characterized by:

endless filaments formed from an organic polymer selected from the group of aromatic polyamides, such as polyparaphenylene terephthalamide, or from polyethylene, polyvinyl alcohol or polyacrylonitrile via solvent spinning;

a matrix formed from a synthetic material based on epoxy resin and/or bismaleimide resin;

the section transverse to the longitudinal direction of the reinforcing element is substantially rectangular, the ratio of thickness to width being smaller than 1:2, and more particularly in the range of 1:8 to 1:90, preferably in the range of the order of 1:8 to 1:20;

a tensile strength of the filament band in the reinforcing element of greater than 2.0 GPa;

a modulus of elasticity of the filament band in the reinforcing element of greater than 60 GPa;

an elongation at rupture of the filament band in the reinforcing element of less than 6%-7%;

resistance to alkali of the reinforcing element determined by the method defined below such that after 180 days at 80° C. the residual strength of the filament band in the reinforcing element is more than 40% of the initial strength.

filaments that form not more than 90% by volume, more particularly 40 to 70% by volume, of the reinforcing element and that the synthetic matrix material forms at least 10% by volume, more particularly 60 to 30% by volume thereof. The alkali resistance of the reinforcing element, in direct contact with the environment of non-carbonated cement or concrete, is such that the residual strength of the filament band in the reinforcing element is higher than 40% of the initial strength, measured as indicated below. By extrapolation it may be inferred therefrom that after 50 years at 20° C. the residual strength of the filament band in the reinforcing element will also be higher than 40% of the initial strength. Surprisingly, it has even been found that alkali resistance of the reinforcing element according to the invention is such that after 180 days at 80° C. the residual strength of the filament band is 60-100%, more particularly about 80-100% of the initial strength. Further, the reinforcing element according of the invention is characterized in that:

the tensile strength of the filament band in the reinforcing element is 2.2-4 GPa, preferably about 3 GPa;

the modulus of elasticity of the filament band in the reinforcing element is 100-200 GPa;

the elongation at rupture of the filament band in the reinforcing element is higher than 1.5%, and is preferably about 2.0-4%.

If the filaments consist of polyparaphenylene terephthalamide (PPDT), then according to the invention the shear strength of the filament band in the reinforcing element is higher than 30 MPa and preferably about 45 MPa. Of the reinforcing element according to the invention the relaxation is less than 10%, but more particularly the relaxation is 3-5%.

According to the invention the reinforcing element is preferably characterized by an epoxy resin of the novolak type or is formed of a resin based on diglycidyl ether of bisphenol A or a tetrafunctional epoxy resin, such as N,N,N'N'-tetraglycidyl4,4'-methylene bisbenzenamine. The epoxy resin is hardened by an amine curing agent, such as a cycloaliphatic amine, a dicyandiamine, an aromatic amine or a polyamine. It is also possible to catalytically hardened the resin with a curing agent based on $BF_3$. According to the invention an accelerator may be added to the synthetic matrix, such as an accelerator may be added to the synthetic matrix such as an accelerator based on $BF_3$, imidazole or dimethyl urea. The synthetic matrix based on epoxy resin according to the invention may in addition to the epoxy resin contain a limited amount of adjuvants, such as particular elastomeric or other thermoplastic substances or adjuvants in an amount of not higher than 20% by weight, calculated on the weight of the resin, which substances may serve, for instance, to improve the elasticity of the matrix. Examples of adjuvants include but are not limited to butadiene/styrol or substances such as polysulphone, polyether sulphone, polycarbonate or polyester. The thermosetting resin also may consist of a mixture or a reaction product of separate components. The resin also may consist of a mixture of various epoxy resins or a mixture of epoxy resin and bismaleimide resin. Or the resin may consist of a mixture of resins capable of forming interpenetrating networks. The reinforcing element according to the invention is characterized in that the bismaleimide resin is a resin based on 4,4'-bismaleimidodiphenyl methane. According to the invention it is preferred that in addition to 4,4'-bismaleimido diphenyl methane the synthetic matrix should contain an amount of allyl phenol, for instance in the ratio of 100:75 parts by weight. Referred to as the XU 292 type, this last-mentioned resin system is elaborately described in the article "High Performance Matrix Resin System" by T. J. Galvin, M. A. Chaudhari and J. J. King of Ciba-Geigy Corp. on pp. 45-48 of Chemical Engineering Progress Jan. 1985. It is of course also possible to include the above-mentioned adjuvants in a matrix of bismaleimide resin. Favorable results are obtained with a reinforcing element which is characterized by filaments having a diameter of between 5-20 μm, preferably about 12 μm. The filaments are so closely surrounded by the special matrix resin that the reinforcing element according to the invention is characterized in that in any random section transverse to the longitudinal direction of the reinforcing element the volume of hollow space is less than 1%, which means that the hollow space is practically eliminated and the internal transmission of force is therefore optimal. The present reinforcing element is substantially flat and is approximately rectangular in cross-section, the ratio of thickness to the width being less than 1:2. With advantage, however, the ratio of the thickness to the width of the reinforcing element is in the range of 1:8 to 1:90, preferably 1:8 to 1:20.

The width of the reinforcing element may be in the range of 10 to 50 mm, and is preferably about 20 mm, and the thickness may be in the range of 1 to 3 mm, and is preferably about 1.5 mm; and viewed in the transverse direction the reinforcing element contains from 3,000 to 20,000 filaments per mm, preferably about 5,000-10,000 filaments per mm. The specific weight of the reinforcing element according to the invention is 1,100 to 1,500 kg/m$^3$, preferably about 1,300 kg/m$^3$.

In addition to the favorable physical and mechanical properties required for use in reinforced concrete the reinforcing element according to the invention surprisingly displays the desired chemical resistance. Particularly favorable is the resistance of the reinforcing element to the strongly alkaline environment prevailing in the fresh concrete and in cement mortar. The reinforcing element according to the invention also displays a good resistance to an acid environment. Because of these properties the use of reinforcing elements according to the invention makes it possible to obtain reinforced concrete, more particularly prestressed concrete, which on the strength of favorable test results in a product expected to have a long service life free of costly repairs in any environment. Particularly, the chemical process taking place in concrete, not containing the device of the invention, as a result of air pollution and acid rain will not damage prestressed or nonprestressed concrete provided with the reinforcing elements according to the invention.

Further, the reinforcing elements of the invention are totally insensitive to electric and magnetic currents, and therefore the reforcing element of the invention can be used in environments where such currents are present and where the use of reinforced or prestressed concrete having steel has been avoided.

An additional advantage of the reinforcing elements of the invention is that due to their low specific weight, i.e., a specific weight a few times lower than that of steel and also lower than the known reinforcing elements of glass filaments in a matrix of polyester resin, they are easy to handle by the building industry. This contributes to lighten the generally hard working conditions in the building industry. The reinforcing elements of the invention formed of relatively thin strips can be cut to size, manually or by machine. An important advantage of the special, substantially flat and rectangular shape of the cross-section of the reinforcing elements according to the invention consists in that the adhesion required for the transmission of force from the cement or concrete mortar to the reinforcing element, or conversely, is considerably better than in the case of a circular cross-section. The use of the non-circular, flattened, approximately rectangular shape of the cross-section transverse to the longitudinal direction of the reinforcing elements according to the invention permits 100% transmission of force over a very limited distance both in the concrete and in the anchoring construction. Such a transmission of force has been found impossible, or in any case costly and complicated, using the circular cross-section commonly employed in steel reinforcement.

Although the reinforcing element according to the invention satisfactorily adheres to the concrete matrix, the adhesion can be further improved if the outer surface of the reinforcing element is made rough and contains a great many irregularities which may be created, for instance, by rolling. Alternatively, the outer surface of the reinforcing element may contain a great many projecting fine-grained particles. Inorganic material, such as silicon oxide, titanium oxide or aluminum oxide, is preferred.

It has been found that the total tensile strength of the filament band in the reinforcing element according to the invention is 5 to 20% higher than the tensile strength of nonembedded filament band.

The invention also comprises a simple process of manufacturing the reinforcing element according to the invention, in which process more than 5,000, and more particularly more than 15,000 practically parallel filaments are collectively embedded in a liquid synthetic material serving as the matrix. The composite is then subsequently cured, particularly by subjecting it to a heat treatment. The filaments have the desired mechanical properties and are formed from a polymer selected from the group of aromatic polyamides, such as polyparaphenylene terephthalamide, or from polyethylene, polyvinyl alcohol or polyacrylonitrile via solvent spinning. The matrix is made from a synthetic material based on epoxy resin and/or bismaleimide resin, more particularly an epoxy resin of the novolak type or an epoxy resin based on diglycidyl ether of bisphenol A or a tetrafunctional epoxy resin, such as N,N,N'N'-tetraglycidyl-4,4'-methylenebisbenzene amine.

A favorable embodiment of the invention is characterized in that the liquid epoxy resin in which the filaments are embedded contains an amine hardener, such as a cycloaliphatic amine, a dicyanodiamine, an aromatic amine or polyamine, the ratio of the amounts, by weight, of epoxy resin and the amine hardener being in the range of 100:25 to 100:40. According to the favorable embodiment use is made of a bismaleimide resin which is formed of a resin based on 4,4-bismaleimidodiphenyl methane supplemented with an amount of allyl phenol, for instance in the ratio of 100:75 parts by weight. The process according to the invention is advantageously characterized in that embedding is effected by passing a filament bed, having a width of at least 5 mm and a thickness of preferably not more than 3 mm under one or more preferably trough-shaped metering devices in which a mixture of liquid matrix resin is fed to the filament bed and the thus impregnated filament bed is passed through a curing zone for the resin, preferably while being subjected to a heat treatment. To reduce the viscosity of the resin, the resin may be preheated in the metering device before it is discharged therefrom. According to the invention the filament bed provided with resin is heated to a temperature of 35°-70° C. before it reaches the curing zone. It has been found that the process for manufacturing the reinforcing element according to the invention is of particular importance for obtaining a proper embodiment of the filaments in said resins. Optionally, the resin-hardner mixture may contain an accelerator, so that the curing time of the epoxy resin may be decreased. To properly embed the filaments in the matrix it is also important that the process be carried out in a vacuum so that air entrapped in the reinforcing element is substantially eliminated. If during embedding the underside of the filament bundle is free, the chance of air being entrapped will be reduced.

According to the invention the reinforcing element can, in a simple manner, be given the thickness desired with a view toward its end use by attaching the widest side face of a formed, at least partly cured strip-shaped reinforcing element, to one or more, preferably two, other identical strip-shaped reinforcing elements, preferably by means of the matrix resin. Thus, according to the invention at least two partly cured or uncured strip-shaped reinforcing elements may be attached to a different side of a reinforcing element by means of a still wet, practically uncured resin, after which the three reinforcing elements thus joined are passed through a curing zone. According to the invention the reinforcing element should be, prior to being completely cured, gauged more particularly by means of transporting gauging rolls which are provided with recesses that correspond to the desired cross-section of the reinforcing element. The at least partly cured reinforcing element can be wound into a reel having an original diameter of, say, 100 cm. A large number of reinforcing elements can be collectively placed in an oven for completely curing the matrix resin for several hours.

The invention also comprises reinforced concrete, more particularly prestressed concrete, which is characterized in that reinforcement is formed by one or more of the described reinforcing elements according to the invention. The concrete according to the invention is characterized in that the ratio of the modulus of elasticity of the concrete matrix to the modulus of elasticity of the filament band in the reinforcing element is in the range of 1:2 to 1:6, preferably about 1:4.

A favorable embodiment of the reinforced concrete according to the invention is characterized in that prior to curing the concrete mortar a chloride-containing curing accelerator is added to the concrete matrix, for instance, in the amounts of 0.5 to 7% by weight of $CaCl_2$, preferably 2 to 5% by weight, calculated on the cement weight in the concrete matrix. Adding $CaCl_2$ to the concrete mortar or cement mortar will cause the curing process to accelerate, which permits removal of the form work at an earlier stage and generally contributes to faster and more efficient building. When use is made of a reinforcement of steel, the addition of $CaCl_2$ is generally undesirable and virtually prohibited in the concrete specifications. $CaCl_2$ promotes the corrosion of steel, as is explained in CUR VB-84-1published by the "Stichting voor onderzoek, voorschriften en kwaliteitseisen op het gebied van beton" ("Institute for tests, regulations and quality standards in the field of concrete"). Under alkaline conditions the chloride ions may break through the protecting passivating film on the steel. The reinforcing elements of the invention are properly resistant to the action of chloride ions. The addition of $CaCl_2$ has the advantage that after a number of years the concrete provided with reinforcing elements of the invention will not be subject to any damage when at some later stage chloride ions penetrate into the concrete, which may happen under the influence of seawater or road salt. Consequently, the use of chloride-containing hardening accelerators, which use in steel reinforcement is severely restricted because of its corrosiveness to steel, achieves considerable economy.

The reinforced concrete according to the invention is also characterized in that the covering or covering thickness of the concrete matrix measured between the outer surface of the concrete matrix and the circumferential surface of the reinforcing element can be practically reduced to nothing and, more particularly, need be as little as 0 to less than 15 mm, preferably about 2-5 mm. Such a thin covering is usually sufficient to permit the transmission of the forces in the concrete to the reinforcing element and conversely.

Use of the conventional steel reinforcement requires a covering partly in order to protect the steel from corrosion, for example, corrosion caused as a result of exposure to carbonation and/or penetration of chloride ions. In the case of steel a covering layer of 15 mm or more need be applied and in the case of prestressed steel a layer of 25 mm or more; and in an agressive corroding environment a covering of 30 and 40 mm must be used. Since the reinforced concrete of the invention only requires a thin layer of concrete, the present invention makes it possible for prestressed or non-prestressed concrete structures, beams, flat or corrugated sheets, respectively for floors and roofs, or other concrete elements to be manufactured economically and efficiently, and further savings may be realized in future maintenance.

The reinforced concrete of the invention advantageously contains a number or a group of reinforcing elements which extend parallel to and at some distance from each other and substantially rectilinear in substantially the same plane in the concrete matrix. There may optionally be provided a second group of such reinforcing elements so that the reinforcing elements of the first and the second groups extend at right angles to each other in two parallel planes.

The invention also comprises a simple process for preparing reinforced concrete, particularly prestressed concrete. In such a case the reinforcement is placed in a form into which the concrete mortar is poured. The process is characterized in that the reinforcement is formed by one or more of the reinforcing elements of the invention and the concrete mortar is brought into direct contact with the reinforcing elements. When the reinforcing elements are in direct contact with cement mortar or concrete mortar the reinforcing elements are properly resistant both to non-carbonated concrete (alkaline environment) and to carbonated concrete.

The invention also comprises a process for the preparation of prestressed concrete. In the preparation of the prestressed concrete, prior to the curing of the concrete, the reinforcing elements of the invention are pretensioned being subjected to an external tensile load. The external tensile load is removed after the curing of the concrete matrix so that the concrete possesses an artificial compressive stress. The external tensile load is of such magnitude that in the cured concrete matrix the tensile stress in each reinforcing element is 40 to 70% preferably about 50%, of the tensile strength of the filament band in the reinforcing element.

With respect to the state of the art reference is again made to the article: "Kunststof profielen met glasvezelwapening" (Glass fiber reinforced sections of synthetic material) in the journal: Metaal en Kunststof of 1983-02-14. Just as in the afore-mentioned article of Weiser and Preis special consideration is given to the product POLYSTAL® of the firm of Bayer. As is known, POLYSTAL® consists of a great many parallel glass filaments contained in a matrix of unsaturated polyester resin. In the first column of the article as reported in Metaal en Kunststof the matrix material may also include other synthetic materials and that the production process also lends itself for processing other reinforcing fibers such as carbon or aramid fibers. However, a reinforcing element according to the invention consisting of the special afore-mentioned combination of PPDT, PE, PVA or PAN filaments embedded in a matrix of epoxy resin and/or bismaleimide resin, and the particularly favorable use thereof in reinforced or prestressed concrete is not mentioned. Although the development of concrete reinforcement consisting of bars of glass filaments embedded in a synthetic matrix dates back to 1972 and although both aramid yarns and epoxy resins were already known at that time, their use in reinforced concrete with the special reinforcing element according to the invention has not been proposed. The use of continuous glass filaments in prestressed concrete has even been known since 1954 (see the article: "A preliminary investigation of the use of fiberglass for prestressed concrete" by Ivan A. Rubinsky and Andrew Rubinsky, Magazine of Concrete Research; Sep. 1954, p. 77). It is believed that in the generally conservative building market the person skilled in the art is prejudiced against the use of synthetic materials in fields where they must satisfy high strength requirements over a long period of time.

In the article "Lifetime Predictions for Polymers and Composites" by R. M. Christensen, Lawrence Livermore Laboratory, University of California, in the Journal of Rheology, 25 (5), pp. 517-528 (1981), p. 24, mention is made of composites of aramid yarns in epoxy resin.

U.S. Pat. No. 4,515,636 proposes the manufacture of concrete sheets reinforced with short fibers of aromatic polyamide. The fibers used have a length, for instance, of 6 mm and are homogeneously distributed throughout the concrete matrix. Such reinforcement is uneconomical in that it requires a relatively large amount of reinforcing fibers of which a considerable proportion is present in places where no reinforcement is required. Moreover, the strength of the aramid fibers is not taken full advantage of.

EP 0,127,198 describes composites for use in aircraft, automobiles and sporting goods. These composites are formed of an epoxy resin with a hardener and a fiber selected from the group of carbon, glass, silicon carbide, poly(benzothiazole), poly(benzimidazole), poly(benzoazole), alumina, titania, boron and aromatic polyamides.

DE 2,653,422 describes a special process for manufacturing fiber-reinforced synthetic strips. Synthetic materials mentioned include thermoplastic and thermosetting materials and a blend of an epoxy resin and a phenolic resin. Fiber materials mentioned include carbon and aromatic polyamide.

NL 7,108,534 describes a process of preparing reinforced, prestressed or unprestressed concrete. In that process a bundle of continuous reinforcing filaments are provided with a resin coating before they are passed into the form. It discloses the use of various resins, viz. unsaturated polyester resin, acrylate resins, epoxy resin and polyurethane resins. Filament materials disclosed include conventional synthetic polymer materials, viz. polyester, polyamide and polypropylene processed by melt spinning, and polyvinyl alcohol and rayon. Although said polymers are particularly suitable for various purposes it has been found that they are not suitable in actual practice to replace steel as reinforcing material in concrete, notably because of the fact that the physical properties of the yarns described in NL 7,108,534, such as tensile strength and modulus of elasticity were too low and their creep generally too high. EP 0,062,491 describes a process for the manufacture of a composite material formed from a matrix containing a reinforcing material of polymer. The polymer is subjected to a plasma treatment in order to improve the adhesion to the matrix. Suitable reinforcing materials (see pages 7 and 8 of said publication) include film, fibrillated film or fibers in the form of monofilaments, multifilament yarn, staple fibers, or optionally a fabric. According to said publication these last-mentioned materials may consist of homo- or copolyolefins, such as polyethylene, polypropylene or a polyethylene-polyester copolymer, and also polyethylene terephthalate, nylon and aramid are mentioned. Suitable matrix materials are thermosetting and thermoplastic resins, polyvinyl chloride, inorganic cement such as Portland or other cement. Preferred thermosetting matrix resins are phenolic resin, epoxy resin, vinyl ester, polyester, etc.

GB 1,425,032 describes a band of carbon filaments held by a water soluble binding material. These bands may be impregnated with matrix material such as a polymer or cement.

U.S. Pat. No. 4,077,577 describes an asbestos-cement pipe manufactured by winding. In addition to the wound asbestos cement layers the pipe consists of helical windings of aromatic polyamide filaments, the filament bundle being directly impregnated with cement.

Japanese patent publication J 57 156 363 and DE 1,925,762 and De 2,848,731 relate to applying surface irregularities to the filaments for the purpose of improving the adhesion to a matrix.

The invention will be further described with reference to a few schematic drawings.

Figure 1:
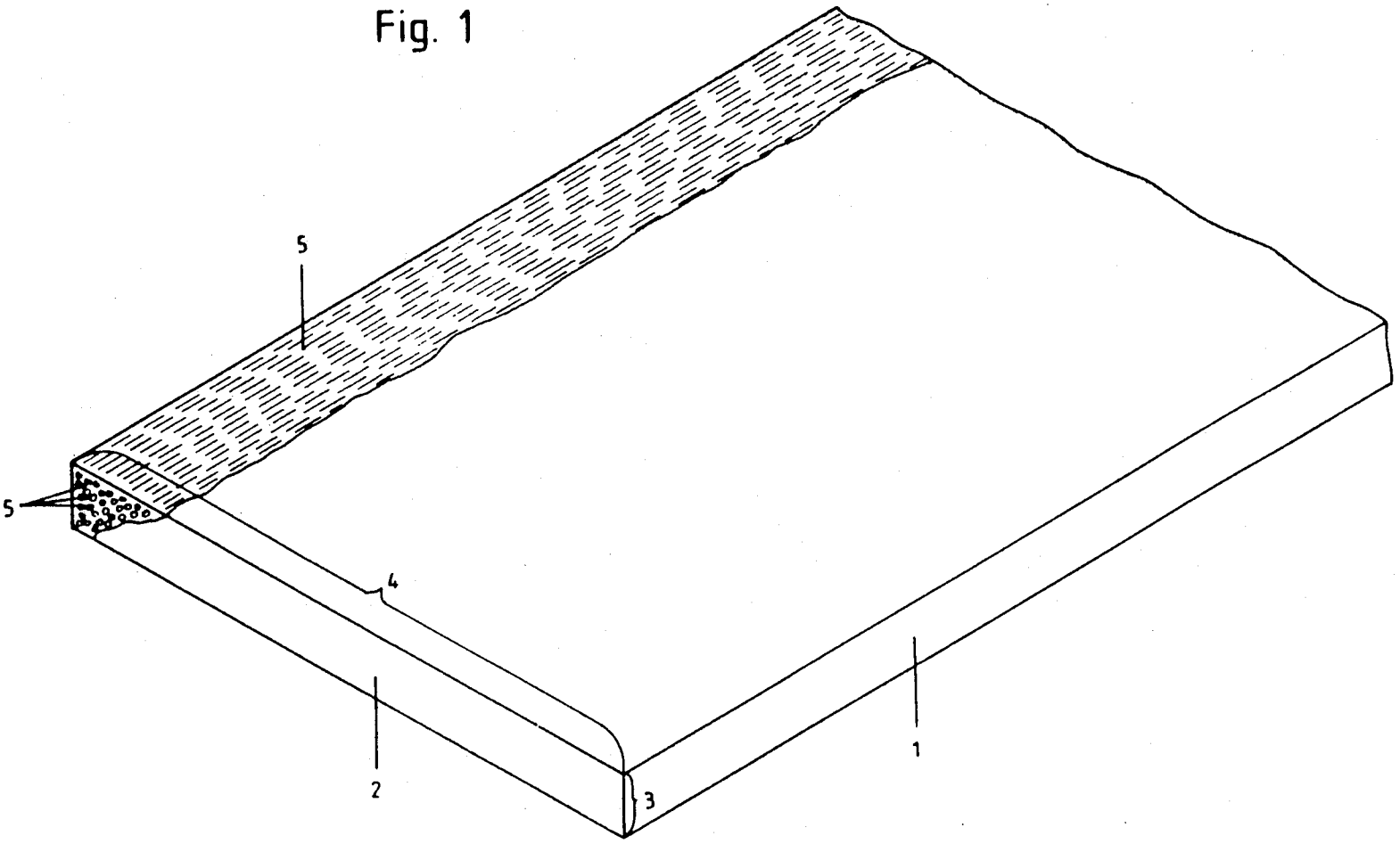
FIG. 1 is a perspective view of the reinforcing element according to the invention.

FIG. 1 is a perspective view on a highly enlarged scale of a reinforcing element 1 according to the invention, of which the rectangular cross-section 2 has a thickness 3 of, for instance at about 1.5 mm and a width 4 of, for instance about 15 mm. The cross-section need not be exactly rectangular. The invention not only comprises rectangular, but also includes more or less flattened or approximately elliptical cross-sections and the wording, substantially rectangular, used in the claims should therefore be interpreted to include such sections. The cross-section 2 consists of a very large number of PPDT filaments 5 having a diameter of 12 μm, as shown in part of the cross-section. The continuous filaments 5 extend uninterruptedly in the longitudinal direction of the reinforcing element. The space between the filaments 5 is entirely filled with epoxy resin serving as a synthetic matrix. If the reinforcing element 1 is not too thick and therefore sufficiently flexible, it can be marketed in the form of a roll. The length of reinforcing material 1 wound into such a roll may amount to a few hundred meters. The length of a reinforcement element required for a particular concrete structure may then be unwound from the roll and cut. The reinforcing material 1 may of course also be supplied in the form of strips of a particular length.

Figure 2:
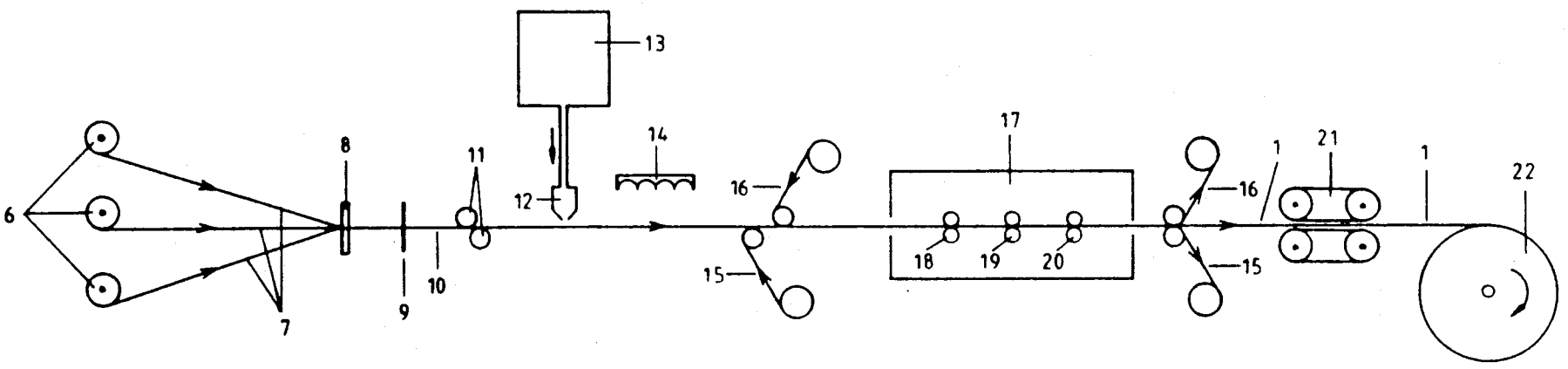
FIG. 2 shows a schematic diagram of an apparatus for manufacturing the reinforcing element of the invention.

FIG. 2 is a schematic representation of an apparatus for the production of the reinforcing element 1 of the type shown in FIG. 1. In a framework (not shown) are placed a large number, for instance about 33, of, for instance, 2 kg packages 6 of PPDT-filament yarn. FIG. 2 shows only three of the yarn packages 6. The PPDT yarns 7 are of the dtex 1610/f 1000 type, which means that each yarn 7 is made up of 1000 filaments measuring 12 μm in diameter. The yarns 7 moving in the direction indicated by the arrow first pass over a guiding means 8 and subsequently a comb 9, so that the filaments will come to lie exactly parallel to each other. Subsequently, the filament bed is passed between a pair of brake and spread drums 11, by which the filaments are given the same tension, after which they pass under a metering slit 12 of the mixing and metering device 13 for the epoxy resin. The mixing and metering device 13 is filled with epoxy resin of the novolak type, and a hardener of aromatic amine, in the weight ratio of resin to amine of 100:38. At the location of the metering slit 12 the filament bed 10 is free at its underside so that under the action of gravity the resin can properly penetrate into the space between the filaments and the entire filament bed 10 is completely impregnated with resin. To improve such impregnation the mouth of the metering slit may also be provided with a heating device (not shown), by means of which the viscosity of the liquid epoxy resin is temporarily decreased. For the same purpose a heating zone having infrared radiators 14 to heat the filament bed to a temperature of 40°-70° C. is provided downstream of the metering slit 12. For further improving impregnation the filament bed may also be preheated, for instance, to a temperature of 30°-70° C. before the resin comes into contact with the filament bed. Then the filament bed impregnated with epoxy resin is covered on its upper and under side with embossed or non-embossed paper release strips 15 and 16 and subsequently passed into a heated curing zone 17, in which the impregnated filament bed is heated to a temperature of about 120° C. The length of the curing zone 17 must be such that at its exit the resin is partly cured. At a travelling speed of 5 m/min the length of the curing zone 17 must be approximately 10 m. After the filament bed has left the curing zone 17, the release strips 15 and 16 are removed from the already fairly hard resin impregnated filament bed, which is then practically in the form of the reinforcing element 1 of the present invention. In the curing zone there are pairs of gauging and guiding rolls 18, 19, and 20 for fixing the proper dimensions of the cross-section of the reinforcing element. The reinforcing element 1 is conveyed through the apparatus by means of a driving unit 21 which exerts a tensile force on the reinforcing element. Downstream of the driving unit 21 is a take up device 22 on which a large length of the produced reinforcing element 1 can be wound. Alternatively, the reinforcing element can be cut into straight pieces of the desired length and collected. Subsequently, the reinforcing element must still be cured, to which end several rolls or a large number of straight pieces of reinforcing material are collectively left in an oven, for instance, for about 8-10 hours, during which time they are subjected to a temperature of about 120° C. to 180° C., depending on the type of resin. Thereafter the reinforcing elements 1 according to the invention are completely ready for use and possess their final properties.

If the filaments are not of polyparaphenylene terephthalamide but of polyethylene, polyvinyl alcohol or polyacrylonitrile, a similar manufacturing process may be used.

To obtain a reinforcing element of optimum quality it is of great importance that the filament bed 10 should be completely impregnated with resin. Therefore, the thickness of the filament bed passing under the metering slit 12 should be relatively small. As a result, the thickness of the reinforcing element 1 to be produced in a single pass will be somewhat restricted. Thicker reinforcing elements 1, however, can be made in a simple manner by bonding together two, three or more partly cured reinforcing elements 1. The bonding agent used is the matrix resin of the reinforcing element. Alternatively, one filament bed in which the resin is still wet and practically uncured may be provided between two already partly cured reinforcing elements. The resulting combination of two, three or more layers of elements must then be adequately cured. In this way the reinforcing elements according to the invention can be made to have practically any desired thickness. The quality of the multi-layer reinforcing element 1 according to the invention is such that the behavior of the end product is identical with that of a single layer reinforcing element.

If a reinforcing element 1 according to the invention is to be composed of several layers in the way described, then use may also be made of a continuous production apparatus. To that end for instance several of the production lines schematically indicated in FIG. 2 may be superimposed and the separate layers will then have to be joined and bonded together in a suitable device. If in the described way two relatively thin layers of 33,000 filaments each are combined with a layer of 34,000 filaments, a final reinforcing element with in all 100,000 filaments will be obtained. In principle it will be possible to manufacture a reinforcing element according to the invention containing 400,000 to 600,000 or 1,000,000 or more filaments.

Figure 3:
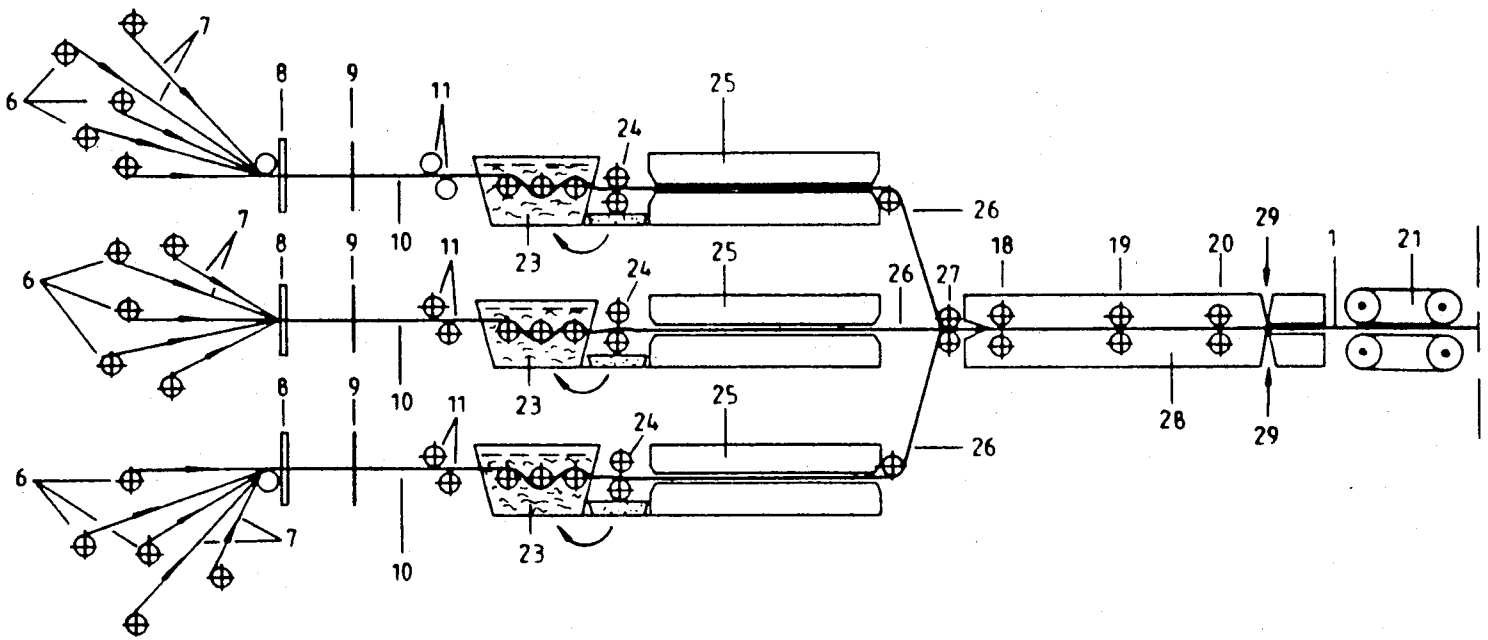
FIG. 3 shows a second schematic drawing of another apparatus for manufacturing the reinforcing element according to the invention.

FIG. 3 shows a somewhat different production process, the parts corresponding to those of FIG. 2 being referred to by like numerals. Three superimposed groups of PPDT filament yarns are impregnated in heatable baths 23 containing a mixture of liquid epoxy resin and hardener. After leaving the impregnating bath 23 each of the three filament beds passes through a pair of squeezing rolls 24 and subsequently through a heated precuring zone 25. After leaving the precuring zone 25 the three preheated elements 26 are joined by means of a pair of pressure and gauging rolls 27 and passed as one element through a communal heated postcuring zone 28. In the first part of the postcuring zone 28 there may be provided a special device (not shown) for feeding (in the direction of the arrows 29) sand, a mixture of sand and resin or some other agent to the element 1 in order to obtain a reinforcing element 1 according to the invention with a rough outer surface. After leaving the postcuring zone 28 the reinforcing element is wound up or cut into straight pieces of limited length. There is again provided a driving unit 21, with which the reinforcing element 1 is pulled through the postcuring zone 28. The freshly produced reinforcing element is hardened by placing a large number of straight pieces in the oven. If the three groups of starting yarns each contain 50,000 filaments, then the reinforcing element 1 produced in accordance with the schematically indicated process of FIG. 3 will contain in all 150.000 filaments.

Figure 4:
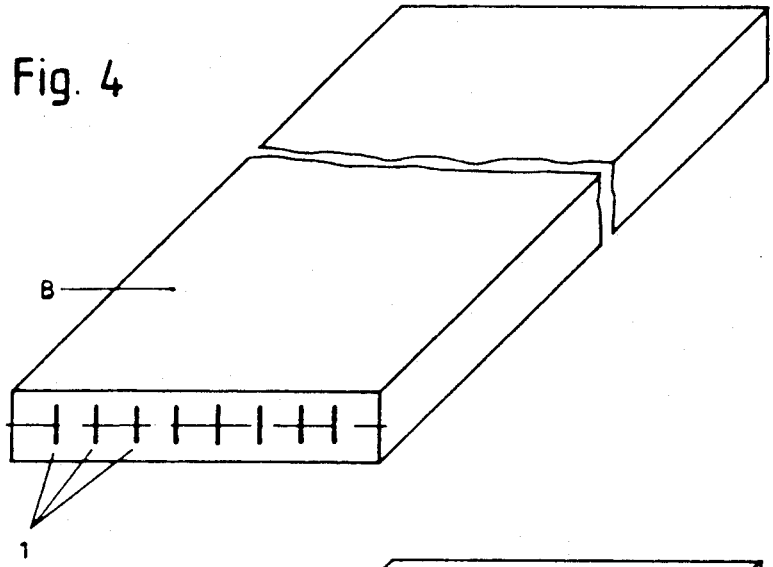
FIGS. 4 and 5 are perspective views of slabs of reinforced concrete according to the invention.
Figure 5:
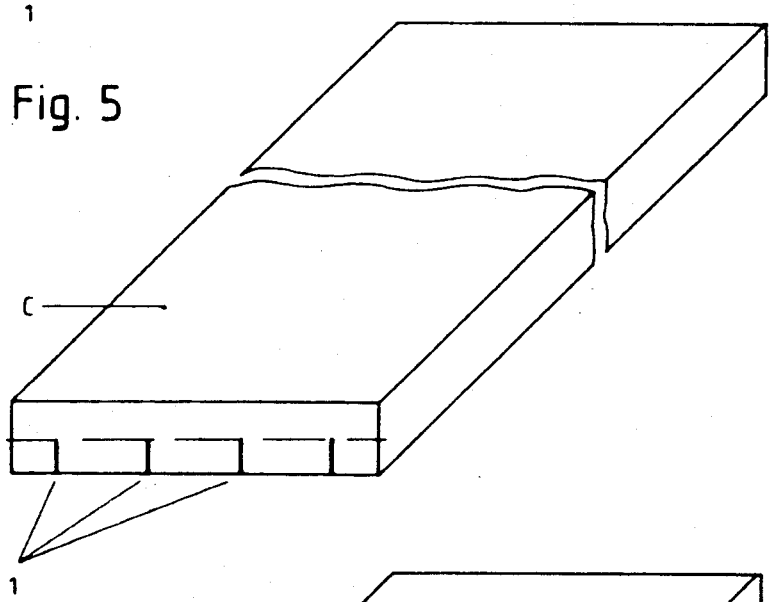
Figure 6:
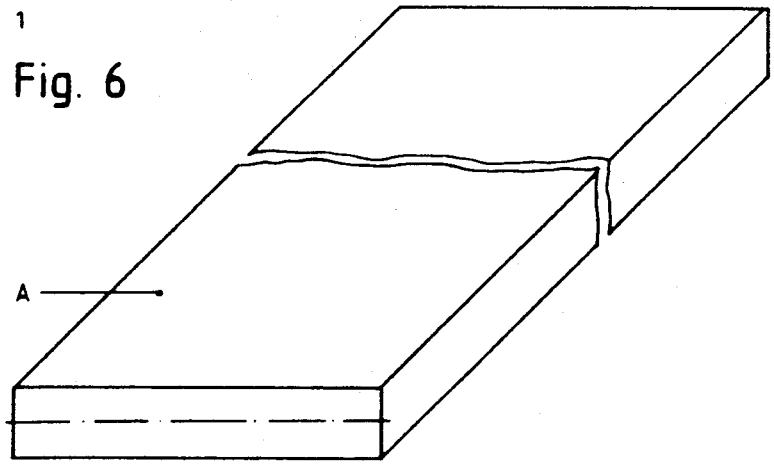
FIG. 6 shows a non-reinforced concrete slab.
Figure 7:
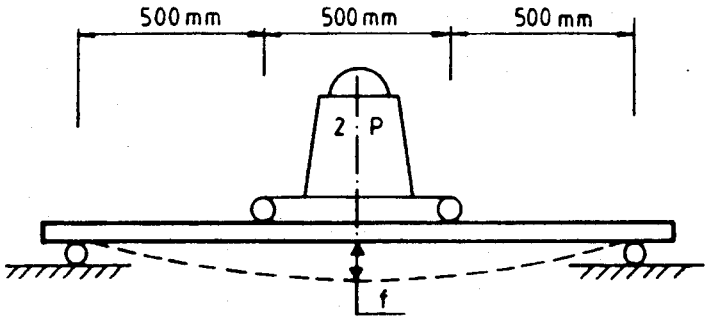
FIG. 7 shows the set-up used in the four-point flexural strength test.

FIGS. 4 and 5 are perspective views of concrete slabs B and C prestressed with reinforcing elements 1 according to the invention. The unreinforced slab A of FIG. 6, is composed of two concrete slabs that measure 1.70 × 0.20 × 0.04 m. The slabs B and C are merely practical examples of prestressed concrete slabs according to the invention. The slabs B, C and A according to FIGS. 4, 5 and 6 were actually made and were tested by subjecting them to the four-point bending test, which is schematically illustrated in FIG. 7. The test is a function of the load 2P in Newton and the deflection f in mm in the various stages was measured. Two slabs of each type B and C were made and tested.

The slabs B according to FIG. 4 are centrally pretensioned with 8 single reinforcing elements 1 (cross dimensions 20 × 0.25 mm and 22.000 filaments of $\phi$12 μm). The total initial prestressing force was 8 × 3000N = 24.000N.

The slabs C according to FIG. 5 are eccentrically pretensioned with four single reinforcing elements 1 (cross dimensions 20 × 0.25 mm and 22.000 filaments of $\phi$12 μm). The total initial prestressing force was 4 × 3000N = 12.000N.

During the pretensioning of the reinforcing elements 1 for the slabs B and C the loss of prestress was measured for 24 hours via a load cell with T.N.O- calibration certificate (measuring accurace ±0.2%). The trend of the prestress losses was recorded. Immediately upon being pretensioned, all the reinforcing elements 1 were sanded over a distance of 200 mm from the ends of the slabs. Sanding was effected by using a hardwood lacquer (varnish) mixed with sand (particle size 0.125 to 0.250 mm), which was applied by brush. Or the reinforcing elements were first treated with lacquer, which was subsequently sprinkled with sand.

Immediately before casting the concrete (24 hours after pretensioning) the loss of prestress (3 to 4%) was made up to the desired prestressing level. The ends of the reinforcing elements were anchored outside the concrete element.

The same anchoring used in earlier tensile tests resulted in a force of 100% of the theoretical tensile strength of a single strip.

In pouring and curing operations for the slabs A, B and C the following procedure was used:

All the slabs were compacted by setting the form work into vibration. For each slab 3 cubes with an edge of 158 mm were made. They were used for determining the cube compressive strength in the various stages of the hardening process and for determining the 28 days splitting tensile strength. Also determined were the water/cement ratio of the concrete mortar used in the slump. All the relevant concrete data were recorded. Following the pouring operation the slabs were cured in the laboratory for 2 × 24 hours, during which periods they were covered with a plastic sheet to prevent dehydration. The temperature in the laboratory ranged from 10° to 16° C. After demolding (after 2 days of curing) the slabs were stored in a conditioning room at a temperature of 20° C. ± 2° C. and a relative air humidity of ≧95%.

When the prestress was removed the reinforcing elements 1 did not display any slippage.

The concrete mortar for test slabs A, B and C was composed of the following:

CHOICE OF THE NOMINAL PARTICLE SIZE

In accordance with NEN 3880 (VB 1974/1984) section 603.5.1.

$\frac{3}{4}$ of the smallest distance between the reinforcing elements.

The smallest distance between the reinforcing elements is 22 mm (centrically pretensioned slab B) $\frac{3}{4} \times 22 = 16.5$.

An aggregate mixture having a nominal particle size of 16 mm is chosen.

GRADING OF AGGREGATE

The aggregate mixture is such that the resulting mixture displays a grading curve which falls between the boundary lines A and B according to NEN section 603.5.3.

CEMENT CONTENT

In accordance with NEN 3880, section 603.8.2 the minimum cement content for B 22.5 class I, consistency range 2 (slump 50-90 mm) and the grading curve between the boundary lines A and B: 320 kg/m$^3$.

Increase due to particle size of 16 mm is 10%:

$$320 + 10\% = 352 \text{ kg/m}^3.$$

Use was made of: 352 kg/m$^3$ class B Portland cement.

CONSISTENCY

In order to compact the test slabs by vibration the concrete mortar was controlled to a slump of 50-90 mm (consistency range 2) after the addition of 3% of superplasticizer Melment LIO, based on the weight of the cement.

| Total swelling calculation (per m$^3$) | | | |
|---|---|---|---|
| Portland cement: | 352 kg 352/3.15 | = | 112 liters |
| Sand/gravel mixture: | 1802 kg 1802/2.62 | = | 688 liters |
| Water + superplasticizer: | 180 kg | = | 180 liters |
| Air (2%): | — kg | | 20 liters |
| | 2234 kg | | 1000 liters |

CONTROLLING THE AMOUNT OF FINES

In accordance with NEN 3880 section 603.6 the minimum amount of fines < 0.250 mm for a nominal particle size of 16 mm = 135 liters m$^3$.

| | | | | |
|---|---|---|---|---|
| 352 kg Portland cement | = | 352/3.15 | = | 112 liters |
| Sand < 1.250 mm | = | $\frac{6 \times 1802}{100 \times 2.62}$ | = | 41 liters |
| Total amount < 0.250 mm | | | = | 153 liters. |

which is consequently sufficient.

The concrete slabs A, B and C shown in FIG. 6, 4 and 5 and made and composed as described above were subjected to two types of loading tests on the 4-point bending tester according to FIG. 7. In the first series of tests all slabs A, B and C were subjected to a bending load only up to the occurrence of visible cracking. The unreinforced slab A cracked immediately. In the second series of tests the slabs B and C were subjected to a bending load up to the occurrence of failure.

RESULTS OF LOADING UP TO CRACKING

The load at which the first crack became visible was determined with the aid of calibrated weights. The loading was increased in steps of 49.05N. The loading was increased every 2 or 3 minutes until the deflection no longer increased. Table 1 gives a summary of the results.

TABLE 1

| Results of the determination of the cracking load | | | | | |
|---|---|---|---|---|---|
| | Slab A | Slab B | Slab B | Slab C | Slab C |
| Calculated cracking load | 476 N | 1116 N | 1116 N | 1276 N | 1276 N |
| Caclulated deflection | 0.8 mm | 2.0 mm | 2.0 mm | 2.3 mm | 2.3 mm |
| Load at which P-f curve is no longer linear | 491 N | 981 N | 1176 N | 1226 N | 1177 N |
| Deflection | 0.9 mm | 1.7 mm | 2.1 mm | 2.2 mm | 2.1 mm |
| Load at which first crack became visible | 713 N | 1860 N | 1909 N | 1762 N | 1909 N |
| Deflection | 1.7 mm | 6.5 mm | 4.0 mm | 4.7 mm | 4.7 mm |

RESULTS OF LOADING UP TO FAILURE

Figure 8:
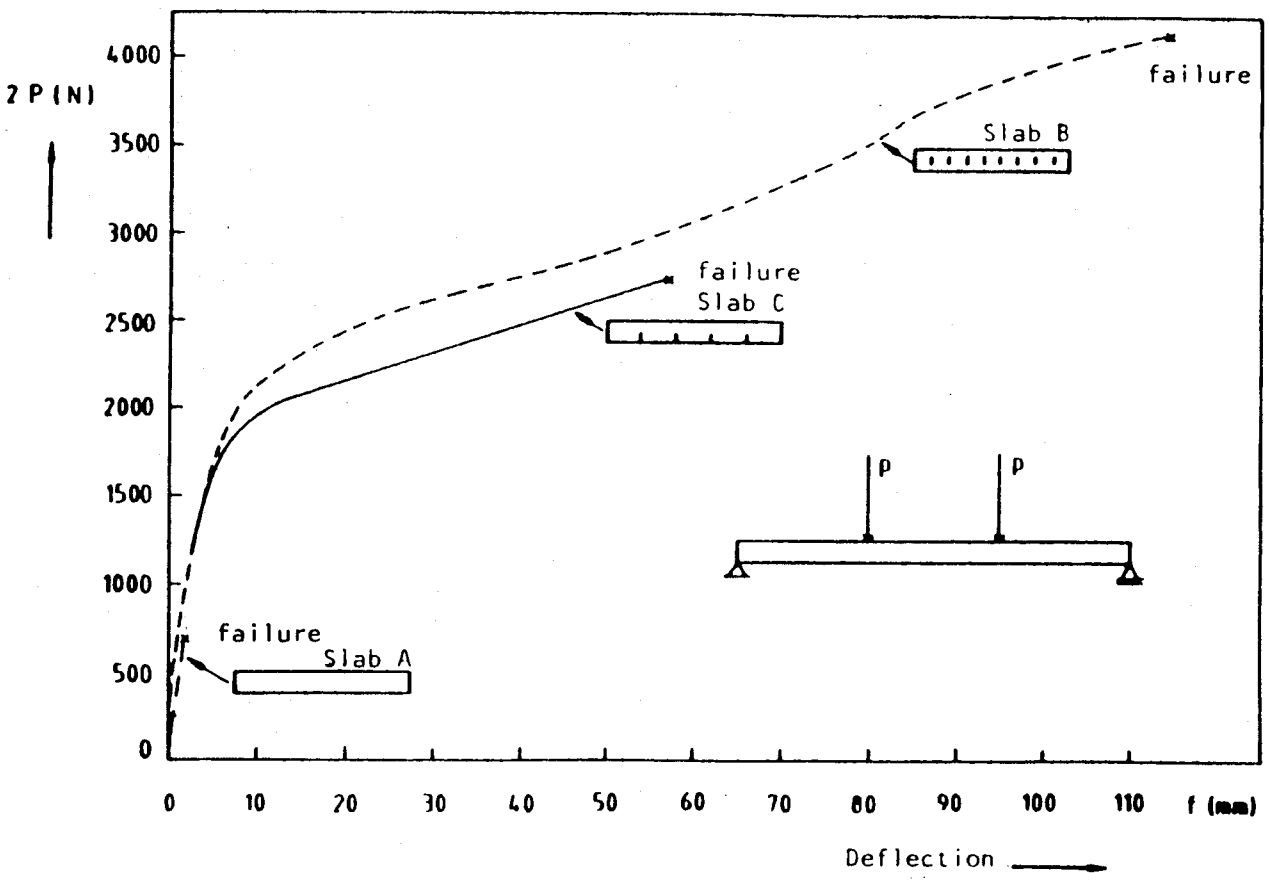
FIG. 8 is a load-deflection diagram.

After a few weeks the test slabs were loaded to the occurrence of failure. The load was increased every 5 minutes. The graph in FIG. 8 shows the relationship between loading and deflection. It appears for instance that after the formation of cracks the structure can still support a large additional load. The deflection will then strongly increase which is a warning of overloading.

Figure 9:
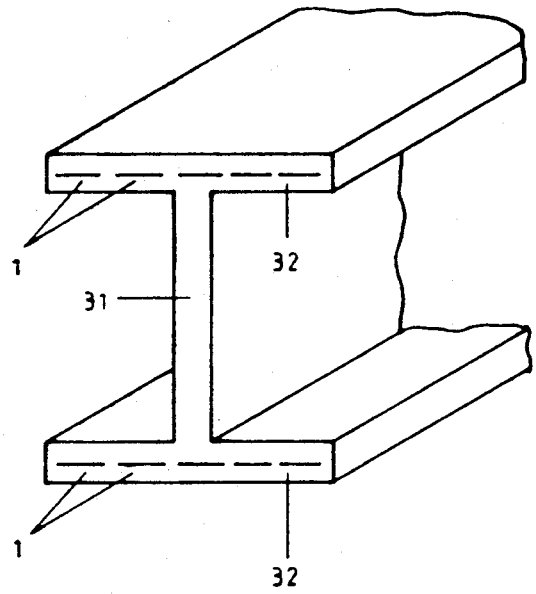
FIG. 9 is a view in perspective of an I-section of reinforced concrete according to the invention.

Slabs B and C are not the only types of slabs in which the invention finds use. Various other prestressed or non-prestressed reinforcing concrete structures can be realized within the scope of the present invention. It is possible, for instance, to make prestressed or non-prestressed reinforced concrete sections, such as the I-beam 31 shown in FIG. 9, which is provided in its flanges 32 with a number of reinforcing elements 1 according to the invention which extend in the longitudinal direction of the beam 31.

Figure 10:
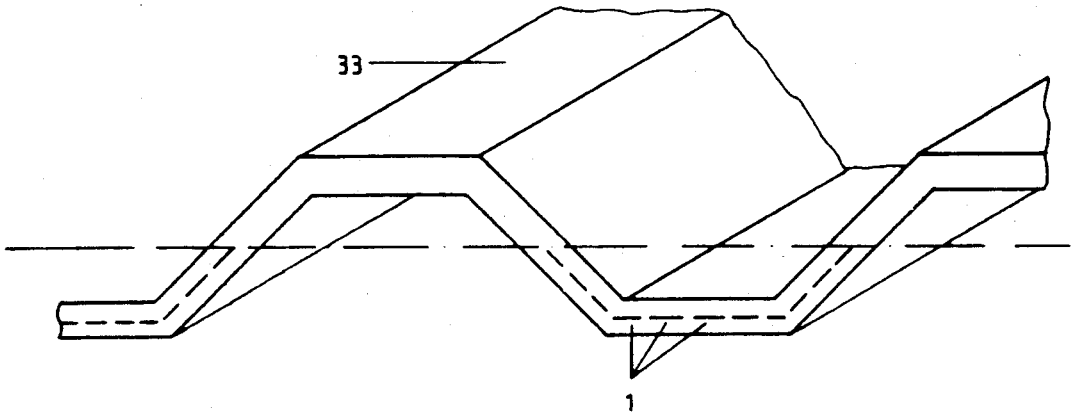
FIG. 10 is a perspective view of a corrugated sheet of reinforced concrete according to the invention.

FIG. 10 illustrates a different construction in the form of a type of prestressed or non-prestressed reinforced concrete corrugated sheet 33, in which in the lower half, to be loaded, is provided with the reinforcing element 1 according to the invention.

FIGS. 11-16 are schematic views in perspective of the reinforcing element 1 according to the invention, provided with different outer surfaces for improving the adhesion to the concrete matrix.

Figure 11:
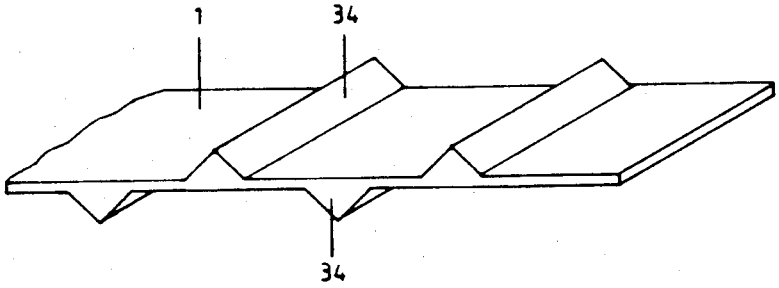
FIGS. 11-16 show various surfaces of the reinforcing element of the invention.

In FIG. 11 the reinforcing element 1 is provided on both sides with ribs 34 which are staggered relative to each other.

Figure 12:
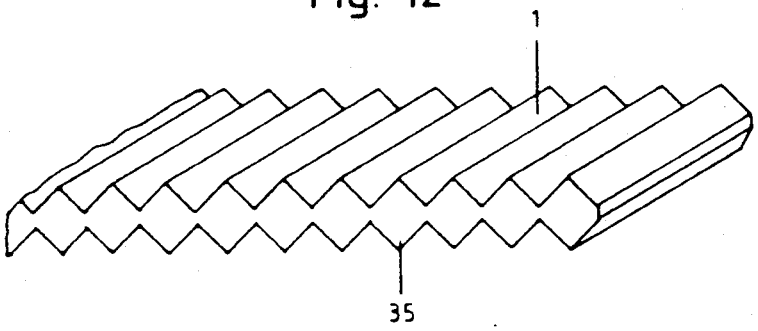

In FIG. 12 both sides of the reinforcing element 1 are entirely in the form of a serrated surface 35.

Figure 13:
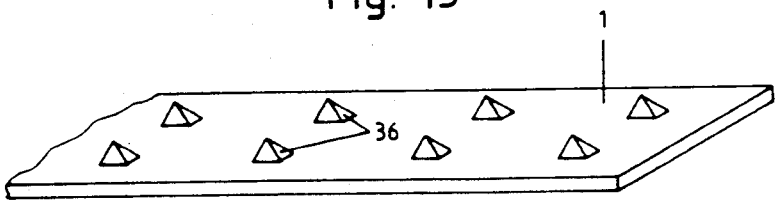

FIG. 13 shows a reinforcing element 1 which is provided with pyramidal projections 36.

Figure 14:
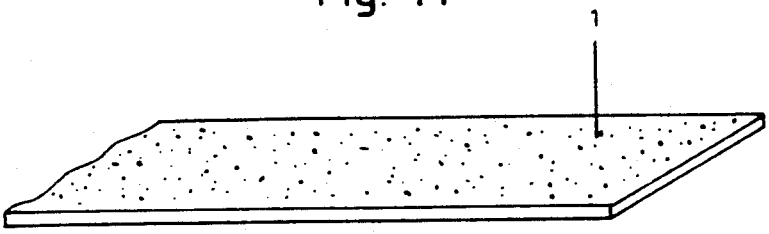

FIG. 14 shows a reinforcing element 1 of which the surface contains a large number of sand granules schematically indicated by dots.

Figure 15:
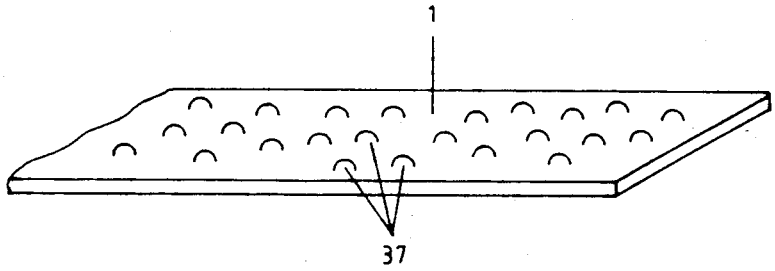

FIG. 15 shows a reinforcing element 1 whose surface is provided with studs 37.

Figure 16:
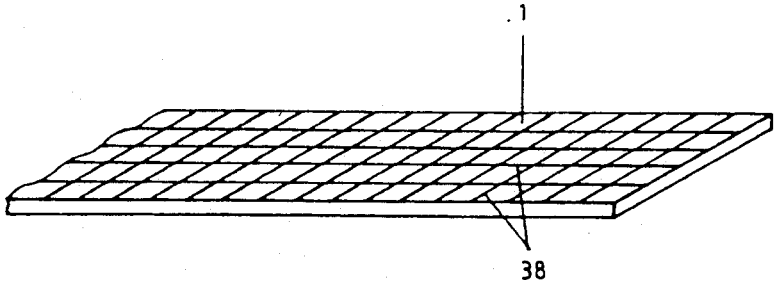

FIG. 16 shows an embodiment of a reinforcing element 1 provided with a grid-shaped pattern of ribs 38, which may be introduced by rolling. The reinforcing elements 1 according to the invention are particularly insensitive to corrosion, and therefore, they only need to be covered with a very thin layer of concrete, which leads to a considerable saving on weight and cost of material. The invention is not at all limited to the concrete elements shown in the Figures. The scope of the present invention allows of many other concrete constructions and concrete elements.

As mentioned above, an important feature of the reinforcing element 1 of the invention resides in the fact that the reinforcing element displays a particularly good resistance to the action of an alkaline environment. Alkaline resistance is determined in the following manner: An adequate number of test specimens of the reinforcing elements of the invention are placed freely in the liquid bath of a saturated $Ca(OH)_2$ solution at a temperature of 80° C. After a period of 180 days at least 6, but preferably 10 test specimens are taken out of the bath. Then these test specimens are washed in water, dried in air at 55° C. and subsequently stored in a conditioned room having a normalized climate (23° C., 65% relative humidity). Following the conditioning of the test specimens the tensile strength of the filament band contained therein is determined in conformity with ASTM 3039/76. From the values found the average tensile strength is calculated. This average tensile strength is referred to as the residual strength. The residual strength is expressed as a percentage of the tensile strength referred to as the initial strength of the reinforcing element not exposed to any environment. The initial strength must be determined sufficiently accurately and in the same way, i.e. in conformity with ASTM 3039/76, on reinforcing elements that have not been exposed to any harmful environment. These non-exposed reinforcing elements are of the same composition as the filaments and the matrix of the reinforcing elements that were exposed to the saturated $Ca(OH)_2$ solution. On the strength of experiments the alkaline resistance of the reinforcing element according to the invention is expected to be such that after 180 days at 80° C. the residual strength of the filament band in the reinforcing element will be more than 80% of the initial strength. If after 180 days at 80° C. the residual strength of a filament band in the reinforcing element is more than 40% of the initial strength, then the reinforcing element has alkaline resistance according to the invention.

Figure 17:
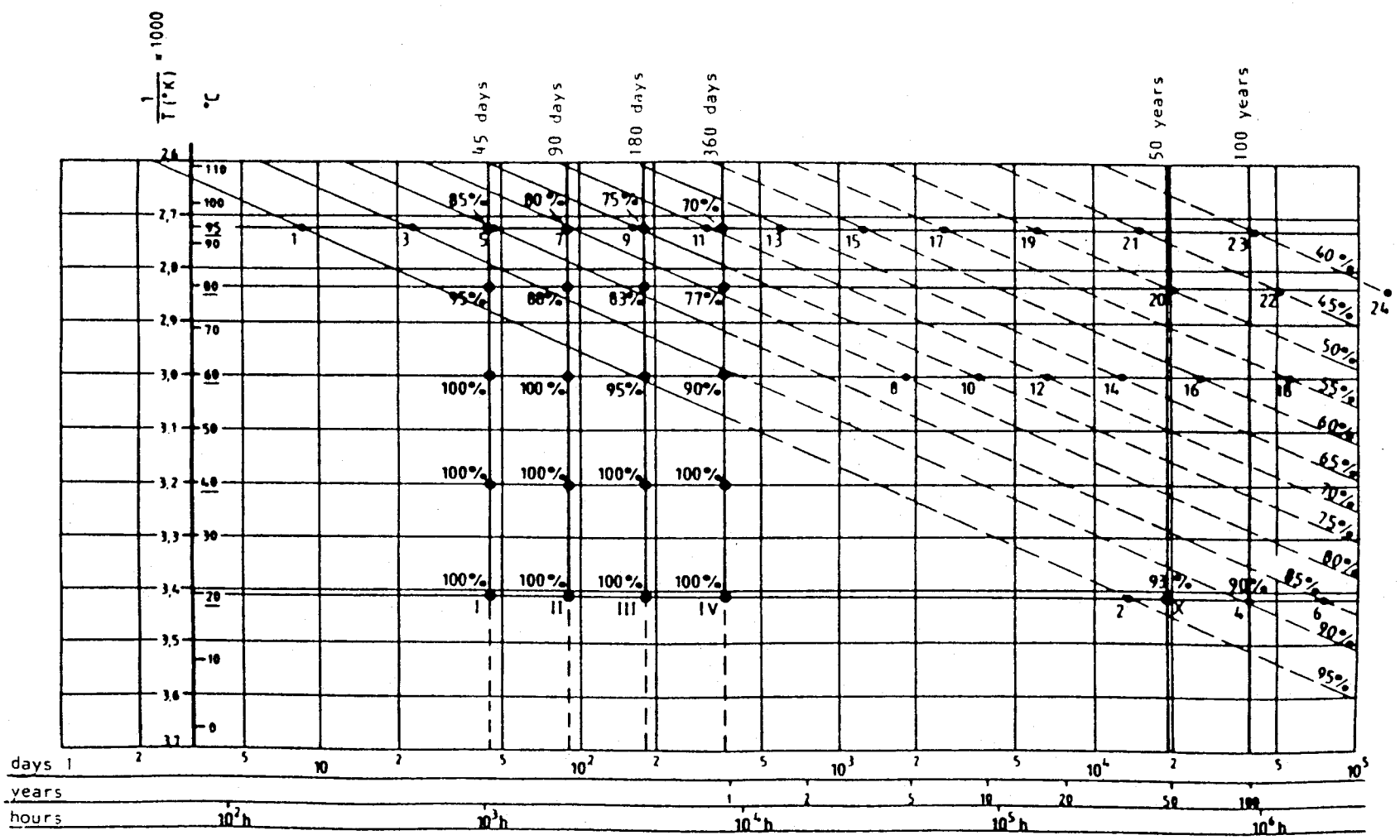
FIG. 17 is the Arrhenius diagram for determining the residual strengths after various residence periods in an alkaline environment.

Projections in regard to the alkaline resistance of the reinforcing element 1 after a very long time, after, for instance 50 or 100 years, is obtained by carrying out the following experiments: A number of test specimens are placed freely in several liquid baths which all contain a saturated $Ca(OH)_2$ solution. The baths have temperatures of 20° C., 40° C., 60° C., 80° C. and 95° C. After certain periods, viz. after 45, 90, 180 and 360 days at least 6, but preferably 10 test specimens are taken from each bath. Subsequently, these test specimens are washed with water, dried in air at 55° C. and are then stored in a conditioned room having a normalized climate (23°, 65% relative humidity). Following the conditioning of the test specimens the tensile strength of the filament band contained therein is determined. Of each series of test specimens the average tensile strength is determined (also in accordance with ASTM 3039/76). This average tensile strength is referred to as the residual strength. The residual strength is expressed as a percentage of the tensile strength (referred to as initial strength, determined as described before) of the reinforcing element that has not been exposed to any medium. The percentages thus found are plotted in a so-called Arrhenius graph, which is given in FIG. 17. On one axis in FIG. 17 is plotted the log of the time in days, years and hours. On the other axis in FIG. 17 is plotted, on a linear scale, the factor $1/T \times 1000$, where T is the temperature in degrees Kelvin. For convenience, also the corresponding values in °C. are given. As shown in FIG. 17 the 20° C.-line in FIG. 17 has four dots I-IV at the end of 45, 90, 180, and 360 days, respectively. Four dots are also on each of the lines for 40° C., 60° C., 80° C. and 95° C. so that in the Arrhenius graph of FIG. 17 there is obtained a grid of, in all, $5 \times 4 = 20$ dots. Each of the 20 dots of the grid represents a particular (mean) residual strength expressed as percentage of the initial strength of the starting material unexposed to a medium and/or an increase in temperature. To find out what dots in the graph represent a residual strength of 95, 90%, 85%, 80%, etc., use is made of a model in accordance with which the residual strength, r is a particular function of the time, t in days, and the temperature T, in degrees Kelvin, such that the contour lines or percentage residual strength lines (lines with constant r) in the Arrhenius graph are parallel straight lines. The model contains a number of unknown parameters which are determined so that the values of the percentage residual strength r predicted with the model, will fit as nearly as possible (minimum sum of squares of deviations) to the measuring values of the residual strength. These measuring values are the empirically determined percentage residual strengths in the $5 \times 4 = 20$ grid dots I-IV. Thus, the contour lines or lines of constant percentage residual strength for r=95%, 90%, 85%, 80%, etc. are fixed and are drawn in the graph of FIG. 17. In the graph of FIG. 17 these contour lines in the zone beyond the longest time (360 days) measured are extended to the 50-year and 100-year lines. The parallel lines thus drawn represent the trends of the percentages residual strength at lower temperatures and/or longer periods.

In the graph of FIG. 17 the dot X sought corresponds to a temperature of 20° C. and a period of 50 years. As appears from FIG. 17, the dot X lies between the residual strength lines of 90% and 95%, so that it may be concluded that for the reinforcing element 1, for which the graph of FIG. 17 is constructed, the expected extrapolated residual strength is still about 93% after 50 years at 20° C. Should the 40% residual strength line be above the X dot, then the extrapolated residual strength of 50 years would be higher than 40%. Should the 40% residual strength be below the X dot, then the extrapolated residual strength after 50 years would be less than 40%.

In the graph of FIG. 17 the position of the residual strength lines was calculated with said model and the measuring values are based on measurements conducted on a reinforcing element of only 1,000 PPDT filaments embedded in an epoxy resin. For all eight grid dots I-IV of the test specimens from baths of 20° C. and 40° C. a residual strength of an average of about 100% was found, which percentages are found by dots in the graph of FIG. 17. At 60° C. the average residual strength values are successively about 100%, 100%, 95% and 90%, after 45, 90, 180 and 360 days, respectively. At 80° C. the residual strength values are successively about 95%, 88%, 83% and 77%, after 45, 90, 180 and 360 days, respectively. At 95° C. the residual strength values are successively about 85%, 80%, 75% and 70% after 45, 90, 180 and 360 days, respectively. The lines of identical residual strength values were determined as described. If the residual strength is determined on a reinforcing element according to the invention containing more than 5,000 filaments, for instance, containing 100,000 to 1,000,000 filaments, then the residual strength will be higher and therefore more favorable than in the case of only 1,000 filaments. It should be added that due to inevitable measuring errors and normal tolerances the dots for the measured percentage residual strength values need not necessarily lie exactly on the corresponding contour lines.

Figure 18:
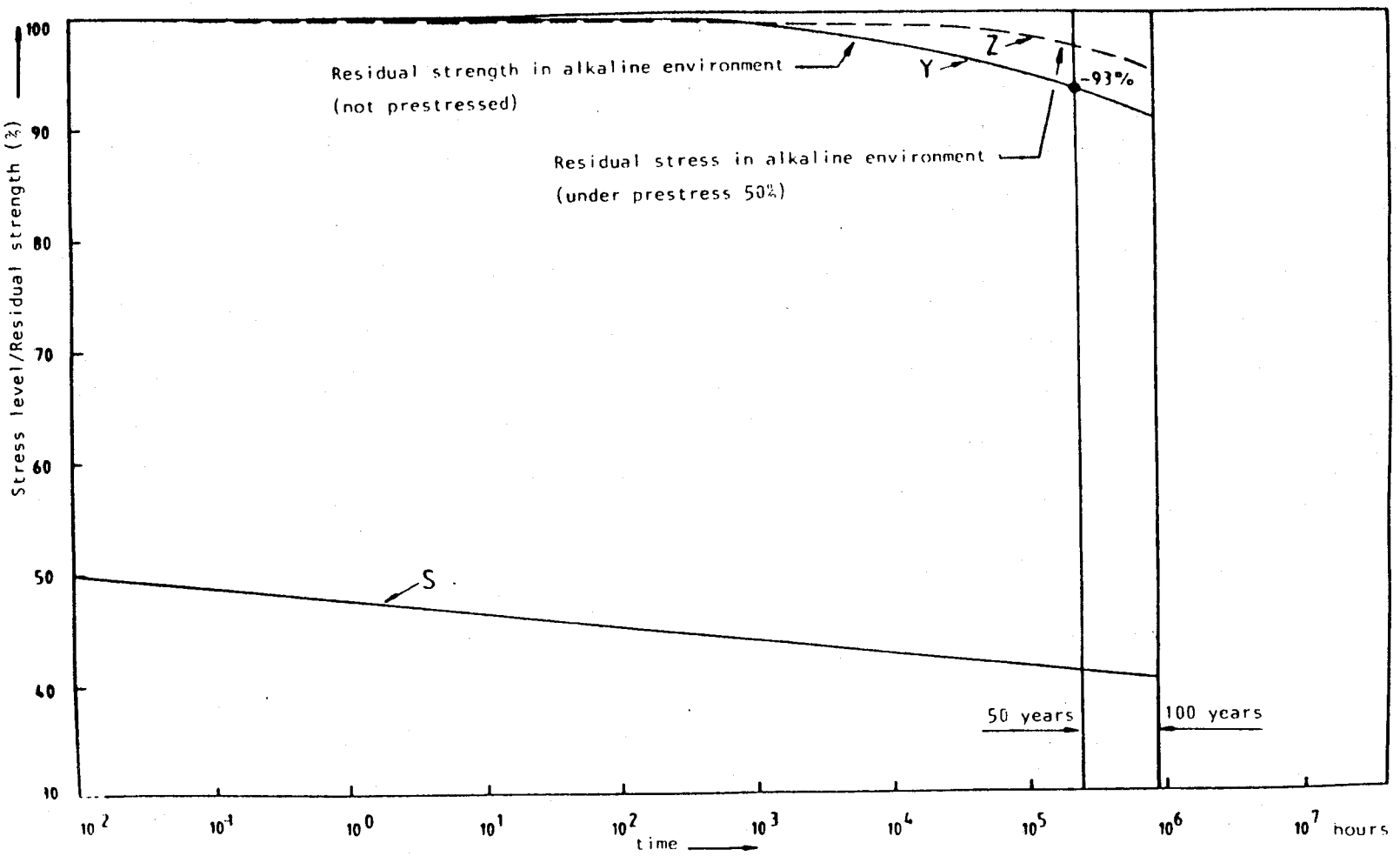
FIG. 18 shows the residual strength in an alkaline medium as a function of time.

On the basis of the data in FIG. 17 the Y line in FIG. 18 represents the residual strength at 20° C. (as a percentage of the initial strength) as a function of time for a reinforcing element with 1000 filaments.

FIG. 18 also gives a Z curve for the residual strength of a reinforcing element prestressed at a load of 50% of the tensile strength. It surprisingly shows that the residual strength of a prestressed reinforcing element is even more favorable and the alkaline resistance of prestressed reinforcing elements according to the invention is even better than that of non-prestressed reinforcing elements according to the invention.

It should be added that FIG. 18 also contains an S line which represents the expected variation of stress with time in a reinforcing element 1 according to the invention which is contained in concrete and which initially has a prestress on the order of 50% of the initial tensile strength.

As to the Arrhenius graph of FIG. 17 it is also noted that the model mentioned with respect to it was as follows:

For constant temperature it was assumed that $$\frac{dr}{dt} = Ar^c;\ A > 0;\ C \geqq 0 \text{ and } r = 1, \text{ for } t = 0$$

where A is a Arrhenius constant, c the reaction order and t the time (in days).

This leads to $$r = \frac{1}{\{A(c-1)t+1\}^{\frac{1}{c-1}} - A \cdot t} \quad \text{for } c \text{ does not equal } 1$$

and r=e for c=1.

For different temperatures A is a function of the temperature:

$$a_1 + a_2(1/T - g) \cdot 10^3$$

$$A = e$$

where

T is the absolute temperature in degrees Kelvin and g is the mean of the inverse of the absolute temperatures, i.e.

$$g = (\overline{1/T})$$

Fitting the model to the measuring values $r_i$ will be such that the sum of squares of the deviations $$\sum_1 (r_i - \hat{r}_i)^2$$

is minimal. Here $\hat{r}_i$ is the value calculated with the model at the same point where $r_i$ was measured. In this fit estimates $\hat{a}_1$, $\hat{a}_2$ and $\hat{c}$ of the parameters (constants) $a_1$, $a_2$ and c, respectively, are obtained. The calculations can be made with a computer program for non-linear regression analysis, such as the "Statistical Software Package BMDP, Program 32". The equations of the contour lines or lines for constant percentage residual strength are For $c \neq 1$ $$\log[t] = -\hat{a}_2\left(\frac{1}{T} - g\right)10^3 \cdot \log[c] - \hat{a}_1 \cdot \log[c] - \log\left[\frac{\left(\frac{1}{r}\right)^{\hat{c}-1} - 1}{c - 1}\right]$$

For $c = 1$ $$\log[t] = -\hat{a}_2\left(\frac{1}{T} - g\right)10^3 \cdot \log[c] - \hat{a}_1 \cdot \log[c] - \log\left[\log\left[\frac{1}{r}\right]\right] - \log[\log[c]]$$

where $g = (\bar{1}/T)$ and $e = 2.7183$ and log [x] the logarithm of x with base = 10.

Using the above model and on the basis of the empirically determined measuring values at the $5 \times 4 = 20$ grid dots in FIG. 17 the following coordinates were calculated of two dots of each contour line in FIG. 17 of constant residual strength values of 95, 90, 85, 80, 75, 70, 65, 60, 55, 50, 45 and 40%.

12 × 2 coordinates for drawing 12 contour lines in FIG. 17.

| Point (No.) | Temp. (°C.) | Residual Strength (%) | log[t] (t in days) |
|---|---|---|---|
| 1 | 95 | 95 | 0.92 |
| 2 | 20 | 95 | 4.13 |
| 3 | 95 | 90 | 1.35 |
| 4 | 20 | 90 | 4.55 |
| 5 | 95 | 85 | 1.67 |
| 6 | 20 | 85 | 4.87 |
| 7 | 95 | 80 | 1.95 |
| 8 | 60 | 80 | 3.26 |
| 9 | 95 | 75 | 2.22 |
| 10 | 60 | 75 | 3.54 |
| 11 | 95 | 70 | 2.50 |
| 12 | 60 | 70 | 3.81 |
| 13 | 95 | 65 | 2.78 |
| 14 | 60 | 65 | 4.10 |
| 15 | 95 | 60 | 3.09 |
| 16 | 60 | 60 | 4.41 |
| 17 | 95 | 55 | 3.42 |
| 18 | 60 | 55 | 4.74 |
| 19 | 95 | 50 | 3.78 |
| 20 | 80 | 50 | 4.31 |
| 21 | 95 | 45 | 4.18 |
| 22 | 80 | 45 | 4.71 |
| 23 | 95 | 40 | 4.62 |
| 24 | 80 | 40 | 5.15 |

The tensile strength, the elongation at rupture and the modulus of elasticity of the filament band were determined in accordance with ASTM-D 3039/76, use being of a tensile rate of 5 mm/min and fixed hydraulic grips. At the grip faces protecting strips (tabs), are provided having a thickness of 1.5–4 times the thickness of the test specimen.

The shear strength of the reinforcing element is determined in accordance with ASTM-D 2344-84, using a span length/thickness ratio of 7:1.

The aromatic polyamides according to the invention are polyamides that are entirely or substantially made up of repeating units of the general formula

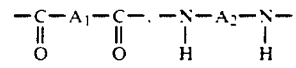

and/or

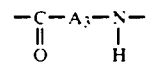

wherein $A_1$, $A_2$ and $A_3$ represent the same or different one or more divalent aromatic rings-containing rigid radicals in which there may be a heterocyclic ring. The chain extending bonds of the rigid radicals are in a position para to each other or they are parallel and oppositely directed. Examples of such radicals include 1,4-phenylene, 4,4'-biphenylene, 1,5-naphthalene and 2,6-naphthalene. They may or may not carry substituents, such as halogen atoms or alkyl groups. In addition to amide groups and the above-mentioned aromatic radicals the chain molecules of the aromatic polyamides may optionally contain 50 mole % of other groups, such as m-phenylene groups, non-rigid groups, such as alkyl groups or ether, urea of ester groups, such as 3,4'-diaminodiphenyl ether groups. It is preferred that the yarn according to the invention should entirely or substantially consist of poly-p-phenylene terephthalamide (PPDT). The manufacture of PPDT yarns is described in U.S. Pat. No. 4,320,081.

The manufacture of plyethylene filaments by solvent spinning may be carried out as described in, for instance, GB 2,042,414, GB 2,051,667 or EP 64,167.

The manufacture of filaments of polyacrylonitrile by solvent spinning may be carried out as described in, for instance, EP 144,983 or JP Patent Application 70 449/83.

The manufacture of filaments of polyvinyl alcohol by solvent spinning may be carried out as described in, for instance, U.S. Pat. No. 4,440,711.

The term concrete as used in the present description refers both to concrete containing natural aggregates (gravel and/or sand) and concrete containing synthetic aggregates. The concrete according to the invention also may contain synthetic additives.

Creep is determined by subjecting a reinforcing element of the invention to a constant load. Prior to being loaded, the length of the test specimen is accurately determined. Following loading the length of the test specimen is measured after t=0.1; t=1; t=10; t=100; and t=1000 hours. Plotting the logarithm of the time on the abscissa and the %-elongation on the ordinate generally results in a straight line. In this way the creep per decade can be given (a decade is a period in which the period of time increases tenfold (e.g., from 100 to 1000 hours).

Relaxation is determined by loading a reinforcing element according to the invention in such a way that the length of the test specimen remains constant. To keep this length constant the force must be continuously reduced. By measuring the force at fixed moments of time the force can be plotted as a function of time. The relaxation is expressed as loss of force (in %) in a certain period, viz. from 0.1 to 1000 hours.

It should be added that the invention is of particular advantage when used with very thin reinforced concrete elements, for instance thinner than 3 cm. Because of the insensivity to corrosion and the atmosphere such thin concrete elements can be provided with the reinforcing elements according to the invention. Such thin concrete elements are not reinforced with steel, unless use is made of very special and costly provisions, such as stainless steel.

An important advantage of the reinforcing elements according to the invention is that they can also be used for reinforcing or prestressing cement or concrete products which for some reason may be porous or water-permeable. Mention may be made in this connection for instance, of concrete containing aggregates such as pumic concrete or cellular concrete, woodwool cement plates, etc.

We claim:

1. A process of producing a prestressed concrete element in which the prestressing force is exerted on the concrete by means of one or more reinforcing elements the process comprising the steps of:

(a) tensioning a reinforcing element, which comprises a plurality of substantially parallel continuous filaments which are embedded in a matrix of a thermosetting synthetic resin, wherein:

the filaments consist essentially of an aromatic polyamide;

the matrix comprises a thermosetting synthetic resin material selected from the group consisting of epoxy and bismaleimide resins;

the tensile strength of the plurality of filaments in the reinforcing element is higher than 2.0 GPa;

the modulus of elasticity of the plurality of filaments in the reinforcing element is higher than 60 GPa;

the elongation at rupture of the plurality of filaments in the reinforcing element is less than 6%;

the plurality of filaments in the reinforcing element form not more than 90% by volume of the reinforcing element and the synthetic matrix material forms at least 10% by volume thereof; and the reinforcing element has a resistance to alkali, such that after 180 days at 80° C. in a saturated $Ca(OH)_2$ solution, the residual strength of the plurality of filaments in the reinforcing element is more than 40% of their initial strength;

(b) casting concrete about the tensioned reinforcing element;

(c) permitting the concrete to harden sufficiently to withstand the prestressing force imparted to the concrete upon release of the tension in the plurality of filaments;

(d) releasing the tension on the reinforcing element to impart a prestress to the hardened concrete;

(e) the tensioning imparting a prestressing force to the concrete element of such magnitude that the tensile stress in the reinforcing element is 40 to 70% of the tensile strength of the plurality of filaments in the reinforcing element.

2. The process according to claim 1, in that the reinforcing element comprises filaments which consist of polyparaphenylene terephthalamide and the diameter of each of the filaments being in the range of 5 to 20 μm.

3. The process according to claim 1, wherein the reinforcing element includes an irregular outer surface for the purpose of improving the adhesion to concrete.

4. The process according to claim 1, wherein the concrete is cast in direct contact with the reinforcing element.

5. The process according to claim 1, wherein the plurality of filaments in the reinforcing element form about 40% to about 70% by volume of the reinforcing element.

6. The process according to claim 1, wherein the synthetic matrix forms about 30% to about 60% by volume of the reinforcing element.

7. The process according to claim 1, wherein the residual strength of the plurality of filaments in the reinforcing element is more than 60% of their initial strength.

8. The process according to claim 1, wherein the tensile stress in the reinforcing element is about 50% of the tensile strength of the plurality of filaments in the reinforcing element.

9. The process according to claim 1, wherein a chloride-containing curing accelerator is added to the concrete.

10. The process of claim 9, wherein the chloride-containing curing accelerator is $CaCl_2$ and is present in an amount of about 0.5 to about 7% by weight calculated on the weight of cement in the concrete.

11. The process according to claim 1, wherein the reinforcing element includes a section transverse to its longitudinal direction which is substantially rectangular.

12. The process of claim 11 wherein the reinforcing element is textured to produce an irregular outer surface.

13. The process of claim 12 wherein the texturing of the outer surface produces irregularities in the form of nobs.

14. The process of claim 11 wherein the ratio of thickness to width of the rectangular cross-section of the reinforcing element is in the range of 1:8 to 1:90.

15. The process of claim 14 wherein the ratio of thickness to width of the rectangular cross-section of the reinforcing element is in the range of 1:8 to 1:20.

* * * * *